United States Patent [19]

Smith

[11] 4,433,645

[45] Feb. 28, 1984

[54] HEAT EXCHANGER

[75] Inventor: Harris W. Smith, Chagrin Falls, Ohio

[73] Assignee: Hunter Investment Company, Cleveland, Ohio

[21] Appl. No.: 265,461

[22] Filed: May 20, 1981

[51] Int. Cl.[3] ..... F22B 23/06

[52] U.S. Cl. ..... 122/136 R; 165/155

[58] Field of Search ..... 165/155; 126/305 A, 126/91 A; 122/367 R, 367 A, 14; 123/41.14

[56] References Cited

U.S. PATENT DOCUMENTS

| | | | |
|---|---|---|---|
| 3,734,066 | 5/1973 | Scheyen | 122/367 R |
| 3,942,719 | 3/1976 | Blomberg | 237/12.3 C |
| 4,105,158 | 8/1978 | Hasebe et al. | 237/12.3 C |
| 4,169,431 | 10/1979 | Viessmann | 122/136 R |

FOREIGN PATENT DOCUMENTS

| | | | |
|---|---|---|---|
| 2458898 | 12/1974 | Fed. Rep. of Germany | 122/136 R |

*Primary Examiner*—William R. Cline

*Assistant Examiner*—John F. McNally

*Attorney, Agent, or Firm*—Fay & Sharpe

[57] ABSTRACT

A heat exchanger includes elongated inner and outer tubular members defining an elongated generally annular passage therebetween. A burner mounted adjacent one end of the tubular members discharges hot gases into the inner tubular member for axial flow therealong and entry into the annular passage adjacent the ends of the tubular members remote from the burner. The gases then flow back through the annular passage for discharge through a lateral exhaust outlet in the outer tubular member adjacent the one end thereof. The annular passage has a varying cross-sectional shape along its length such that a major portion of the gases enter the annular passage at a location diagonally opposite from the exhaust outlet and then flow both longitudinally and circumferentially along the annular passage toward the exhaust outlet. The heat exchanger is particularly useful in heating diesel engine coolant to facilitate more rapid engine starting.

15 Claims, 5 Drawing Figures

HEAT EXCHANGER

BACKGROUND OF THE INVENTION

This invention relates to the art of heat exchangers and, more particularly, to heat exchangers of the type having a fuel burner firing into a combustion chamber surrounded by an annular heat exchange passage through which fluid is circulated for receiving heat from the combustion chamber.

The invention is particularly applicable for use with a diesel fired coolant heating system and will be described with specific reference thereto. However, it will be appreciated that the invention has broader aspects and may be used for other purposes.

It is well known that diesel engines are difficult to start at relatively low temperatures. For this reason, it is common to leave a diesel engine idling for long periods of time so the engine will not cool down to the point where starting would be difficult. Such continuous idling wastes diesel fuel and a number of arrangements have heretofore been proposed for keeping a diesel engine warm without the necessity for continuously running the same. One prior arrangement includes a separate heat exchanger through which the diesel engine coolant liquid is circulated by means of a pump as shown, for example, in the commonly assigned U. S. Pat. No. 4,099,488 to Damon, the teachings of which are incorporated hereinto by reference. In the device disclosed by this patent, a diesel fuel burner fires into the combustion chamber of a heat exchanger. The water and antifreeze liquid coolant from the diesel engine is circulated by a pump through a heat exchange passage surrounding the combustion chamber with necessary thermostats and controls being provided to maintain the desired temperature of the diesel engine coolant liquid. The use of a diesel fuel burner in the heat exchanger thus makes it possible to employ the same fuel source as the diesel engine.

The heat exchanger there used includes elongated concentric inner, central and outer tubular members which define first and second elongated annular exhaust passages therebetween. The diesel fuel burner is mounted adjacent one end of the tubular members and discharges hot gases into the interior of the inner tubular member. These hot gases flow in one direction through the inner tubular member and then generally reverse direction by flowing through a plurality of openings spaced toward the opposite end of the inner tubular member and into the first annular passage. The hot gases then pass into the second annular passage adjacent the one end, generally reverse direction and flow back along this second annular passage. The hot gases are ultimately discharged through an exhaust outlet associated with the outer tubular member at the end thereof spaced remote from the burner. A housing surrounding the outer tubular member defines an annular heat exchange passage through which the diesel engine coolant flows. An arrangement of this type induces more complete combustion of the fuel-air mixture by providing a relatively long flow path for the products of combustion. However, and while the construction disclosed by the Damon patent has provided generally satisfactory results, it has been found that the inner tubular member deteriorates prematurely because of the manner and nature of the flow of hot gases in communication therewith.

Another heat exchanger construction is disclosed in U.S. Pat. No. 3,358,651 to Maruyama. In this arrangement, inner and outer tubular members are provided for defining an annular exhaust passage therebetween. Hot gases from a burner flow in one direction through the inner tubular member and then generally reverse direction to flow back through the annular passage. The inner tubular member is of double-wall construction and liquid is circulated through the space between these walls. As a result, the inner surface of the inner tubular member will always be at a relatively low temperature. This is unsatisfactory in a heat exchanger having a diesel fuel burner because the inner surface will soon be coated with carbon which greatly reduces the heat transfer characteristics and also reduces the combustion efficiency. The inner surface of the inner tubular member must be maintained at a highly elevated temperature in order to prevent formation of carbon deposits and for enhancing combustion of the fuel-air mixture at it travels through the inner tubular member. Also, the inner tubular member is of a generally conical configuration which makes it more difficult to fabricate.

In this Maruyama patent, the inner tubular member is laterally offset relative to the outer tubular member so the annular passage is not symmetrical about the inner tubular member longitudinal axis. However, the annular passage progressively decreases in size toward the exhaust outlet in a uniform manner and the portion of the annular passage disposed on the opposite side of the inner tubular member from the exhaust outlet always remains larger in area than the portion of the annular passage disposed on the side of the inner tubular member which faces the exhaust outlet. With an arrangement of this type, the exhaust gases follow the path of least resistance and simply flow longitudinally through the annular exhaust passage on the side thereof opposite from the exhaust outlet and do not cross over to the side of the exhaust outlet until the gases have traveled substantially the full length of the passage. Thus, the walls of the annular exhaust passage are not uniformly heated to a high temperature and inefficient heat transfer occurs from the wall of the outer tubular member to the coolant fluid flowing through the heat exchange passage.

The present invention contemplates new and improved apparatus which overcomes the foregoing specific problems and others and provides a new heat exchanger construction which is simple, effective, economical and particularly adapted to use in the environment of a diesel fueled engine coolant heater.

BRIEF SUMMARY OF THE INVENTION

A heat exchanger of the type described including inner and outer tubular members cooperatively positioned to define an annular exhaust passage therebetween. This passage has a varying cross-sectional shape along the length thereof such that a majority of the gases from a burner enter the passage at a location diagonally opposite from the exhaust outlet and then flow both longitudinally and circumferentially along the annular exhaust passage toward the exhaust outlet.

More specifically, the subject new heat exchanger has a longitudinal axis along which a plane extends to provide a reference for portions of the heat exchanger located on opposite sides of that plane. Elongated inner and outer tubular members have first and second opposite ends and extend generally along the axis in cooperative relationship to one another to define a generally annular passage therebetween. The second end of the inner tubular member is open and the second end of the outer tubular member is closed so that hot gases directed into the first end of the inner tubular member flow therealong toward the second ends where the gases flow around the second end of the inner tubular member and into the annular passage. An exhaust outlet is provided in the outer tubular member adjacent the first end thereof on one side of the referenced plane.

In the preferred arrangement, the tubular members are cooperatively positioned such that the annular passage on the one side of the plane in which the exhaust outlet is provided has a cross-sectional area which is a minimum adjacent the tubular member second ends and gradually increases toward the first ends. On the opposite side of the reference plane, the annular passage has a cross-sectional area which is a maximum adjacent the tubular member second ends and gradually decreases toward the first ends. With this arrangement, a major portion of the burner exhaust gases flow from the inner tubular member around the second end thereof and into the annular passage on the opposite side of the plane from the exhaust outlet. Thereafter, the gases flow generally longitudinally along and circumferentially around the annular passage over to the one side of the plane for discharge through the exhaust outlet.

Also in the preferred arrangement, the annular passage is completely closed over a substantial peripheral portion thereof adjacent the second ends of the tubular members at a location in longitudinal alignment with the exhaust outlet. This insures that a major portion of the exhaust gases will enter the annular passage at a location diagonally opposite from the exhaust outlet.

The inner and outer tubular members are preferably substantially cylindrical as this facilitates ease of heat exchanger fabrication. The tubular members are positioned in skewed relationship such that the longitudinal axis of the inner tubular member crosses the longitudinal axis of the outer tubular member at a location intermediate the tubular member first and second ends.

The heat exchanger is constructed for mounting with its longitudinal axis extending horizontally and with the lateral exhaust outlet extending vertically downward. Further, the annular exhaust passage has a substantially uniform cross-sectional area along the length thereof. However, the shape of this passage continuously varies for achieving the longitudinal and circumferential flow of exhaust gases therethrough.

It is a principal object of the present invention to provide a new and improved diesel fired heat exchanger having improved heat transfer and combustion features.

It is also an object of the invention to provide such a heat exchanger which is very simple to manufacture and assemble.

It is an additional object of the invention to provide a heat exchanger in which exhaust gases are forced to flow in such a manner that the inner and outer walls of an exhaust passage are maintained at a substantially uniform temperature.

Further objects and advantages for the invention will become apparent to those skilled in the art upon a reading and understanding of this specification.

BRIEF DESCRIPTION OF THE DRAWINGS

The invention may take form in certain parts and arrangements of parts, a preferred embodiment of which will be described in this specification and illustrated in the accompanying drawings which form a part hereof and wherein.

DETAILED DESCRIPTION OF A PREFERRED EMBODIMENT

Figure 1:
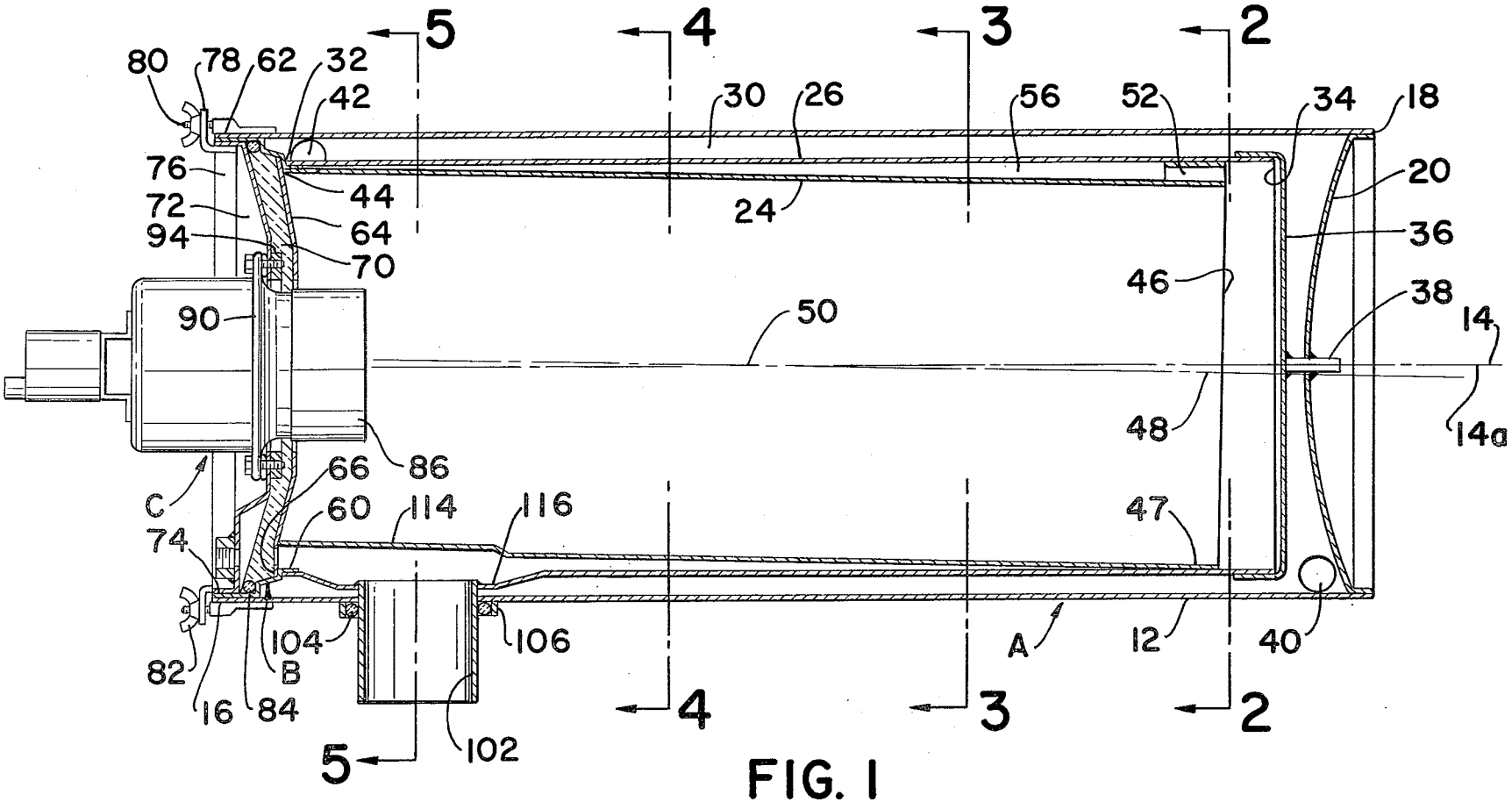
FIG. 1 is a side elevational view in cross-section of the new and improved heat exchanger constructed in accordance with the present invention.
Figure 2:
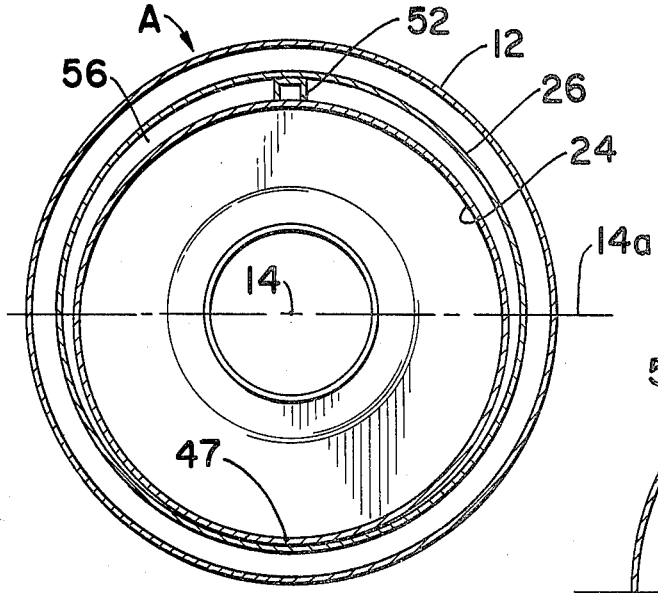
FIG. 2 is a cross-sectional view taken generally along lines 2—2 of FIG. 1.
Figure 3:
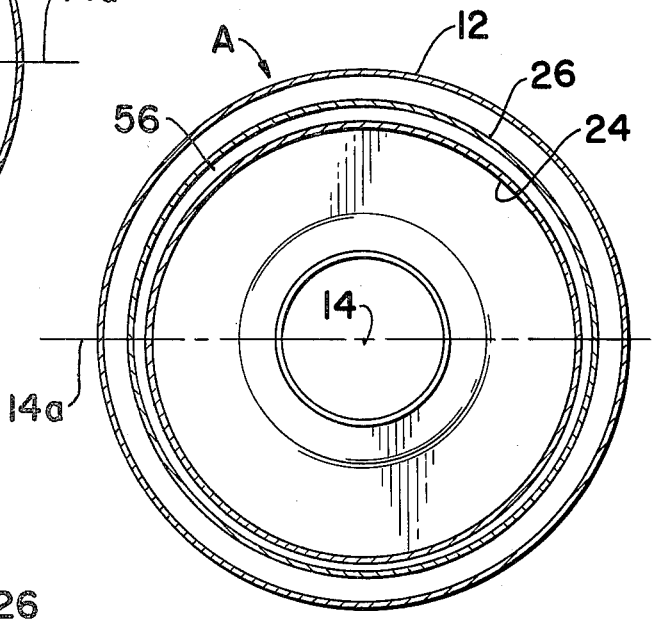
FIG. 3 is a cross-sectional view taken generally along lines 3—3 of FIG. 1.

Referring now to the drawings wherein the showings are for purposes of illustrating the preferred embodiment of the invention only and not for purposes of limiting same, FIG. 1 shows a heat exchanger A including an outer tubular housing 12 in the form of a cylinder having a longitudinal axis 14. Housing 12 has a normally open end 16 and a closed end 18 provided by welding an end plate 20 thereto.

Inner and outer tubular members 24,26 are positioned within housing 12 extending generally along longitudinal axis 14 thereof. Outer tubular member 26 is cylindrical and has a smaller diameter than housing 12. The longitudinal axis of outer tubular member 26 is substantially coincidental with housing longitudinal axis 14 so that an elongated annular heat exchange passage 30 is defined between housing 12 and outer tubular member 26. Passage 30 has a substantially uniform cross-sectional size along substantially its entire length and is also substantially symmetrical about longitudinal axis 14.

Outer tubular member 26 has a first end 32 and an opposite second end 34 which is closed by an end plate 36 welded thereto. A stud 38 welded to the center of end plate 36 extends outwardly therefrom and through a suitable central opening in housing end plate 20. The stud is also welded to plate 20 with end plates 20,36 being axially spaced from one another. Thus, stud 38 defines a support means for supporting outer tubular member 26 concentrically within housing 12 and for maintaining closed ends 20,36 in a spaced apart relationship.

Inlet and outlet ports 40,42 penetrate housing 12 generally tangentially thereof adjacent ends 18,16, respectively. Ports 40,42 are also diagonally opposite one another. The liquid coolant for a diesel engine is connected by supply and return lines (not shown) with inlet and outlet ports 40,42. A suitable pump (also not shown) is provided in the supply line so that the coolant liquid swirls around annular heat exchange passage 30 as the coolant moves from right to left therethrough. One possible arrangement for this purpose is, however, shown in the commonly assigned U. S. Pat. No. 4,099,488 which is incorporated hereinto by reference. The location of parts 40,42 closely adjacent housing ends 18,16 is desirable to maximize heat transfer to the coolant for reasons which will become apparent hereinafter.

Inner tubular member 24 is also cylindrical and of a smaller diameter than outer tubular member 26. Inner tubular member 24 has a first end 44 substantially axially aligned with first end 32 of outer tubular member 25. Inner tubular member 24 has a length slightly less than outer tubular member 26 and includes an opposite second end 46 spaced axially from second end 34 of outer tubular member 26.

Inner tubular member 24 is skewed within outer tubular member 25 so that the longitudinal axis 48 of inner tubular member 24 crosses longitudinal axis 14 of housing 12 and the axis of outer tubular member 26 at a point generally indicated at 50 located intermediate first and second ends 32,44 and 34,46. Crossing point 50 is actually approximately one-third of the distance from second end 46 toward first end 44. A suitable clip 52 wedged between inner and outer tubular members 24,26 adjacent second ends 34,46 thereof holds inner tubular member 24 in its skewed position relative to outer tubular member 26 adjacent second ends 34,46. Inner tubular member 24 is actually in firm engagement with outer tubular member 26 at 47 over a substantial peripheral distance adjacent second end 46 opposite from clip 52. First ends 32,44 of inner and outer tubular members 24, 26 may also be held in skewed relationship by suitable clips, by spot welding or by other convenient means. Inner tubular member 24 is skewed such that the bottom portion of second end 46 in FIG. 1 engages outer tubular member 26 while first end 44 has its upper portion engaging outer tubular member 26. This arrangement provides an elongated annular space 56 extending between elongated inner and outer tubular member 24,26. Annular passage 56 has a cross-sectional shape which continuously varies along its length while remaining of substantially constant cross-sectional area.

A mounting ring B has an inner cylindrical flange 60 closely received within first end 32 of outer tubular member 26 and suitably secured thereto as by welding. First end 44 of inner tubular member 24 is urged upwardly in the view of FIG. 1 against the inner surface of inner flange 60 on mounting ring B. An outer cylindrical flange 62 on mounting ring B is closely received within end 16 of housing 12 and suitably secured thereto.

A shield plate 64 has its outer peripheral portion positioned against a shoulder 66 on mounting ring B. A suitable high temperature resistant insulating material 70 is positioned against shield plate 64. A burner mounting plate 72 has an outer flange 74 closely received within outer flange 62 on mounting ring B and an assembly ring 76 is closely received within flange 74 on the burner mounting plate. A plurality of circumferentially spaced lugs 78 on assembly ring 76 include openings therethrough receiving threaded studs 80 welded to the outer periphery of housing 12 adjacent end 16 thereof. Wing nuts 82 cooperate with threaded studs 80 for urging assembly ring 76 to the right in the view of FIG. 1 to compress insulating material 70 between shield plate 64 and burner mounting plate 72. An O-ring 84 of asbestos or other high temperature resistant insulating material is positioned against another shoulder on mounting ring B and is compressed by burner mounting plate 72.

Shield plate 64 and burner mounting plate 72 have aligned central circular holes therethrough for receiving a forward portion 86 of a burner C. A suitable outwardly extending peripheral flange 90 is provided on the burner and has axial holes therethrough aligned with holes in mounting plate 72. Nuts 94 having threaded openings therein are welded to the opposite side of burner mounting plate 72 in alignment with the holes in mounting plate 72 and burner flange 90 to accommodate receipt of conventional mounting members for burner C.

Diesel fuel and air are supplied to burner C in a known manner for combustion within the combustion chamber defined within inner tubular member 24. The hot gases produced by burner C are ultimately discharged through an exhaust outlet 102 extending through aligned lateral holes in inner tubular member 24 and housing 12. An O-ring 104 of high temperature resistant insulating material is positioned around exhaust outlet tube 102 and retained thereagainst by a retaining ring 106. Inner and outer tubular members 24,26 have flat portions 114,116 adjacent first ends 32,44 thereof and aligned with exhaust outlet 102.

In the arrangement shown and described, it will be recognized that burner C is mounted to the heat exchanger adjacent first ends 32,44 of inner and outer tubular members 24,26. The hot gases produced by burner C flow in a direction from first ends 32,44 toward opposite second ends 34,46. Upon arriving at second end 46 of inner tubular member 24, the hot gases generally reverse direction and flow back through annular exhaust passage 56 for discharge through exhaust outlet 102. Coolant liquid circulating through annular heat exchange passage 30 receives heat from outer tubular member 26 which is heated to a very high temperature by the exhaust gases passing through annular exhaust passage 56.

In the improved arrangement of the present application, inner tubular member 24 is fabricated from a high temperature resistant steel alloy, while outer tubular member 26 and housing 12 may be fabricated from a lower quality steel. The peripheral wall of inner tubular member 24 is heated by the hot gases flowing along both the interior and exterior surfaces thereof. Maintaining the peripheral wall of inner tubular member 24 at a very high temperature substantially eliminates formation of carbon deposits on these surfaces and enhances complete combustion of the fuel-air mixture. The cross-sectional area of annular exhaust passage 56 is substantially smaller than the cross-sectional area of annular heat exchange passage 30. In one arrangement, the cross-sectional area of annular exhaust passage 56 may be approximately one fourth the cross-sectional area of annular heat exchange passage 30. Likewise, the diameter of circular exhaust outlet 102 may be approximately one fourth the diameter of cylindrical outer tubular member 26.

The shape of annular exhaust passage 56 varies along the length thereof in order to provide enhanced flow of exhaust gases therethrough both longitudinally and circumferentially thereof. This causes the hot exhaust gases to flow around and along the entire periphery of inner tubular member 24 and outer tubular member 26 for transferring heat thereto. As shown in FIG. 1, the area of annular exhaust passage 56 at a location adjacent second ends 34,46 of tubular members 24,26 is at a maximum diagonally opposite from exhaust outlet 102 (at clip 52). Annular exhaust passage 56 at a location adjacent second ends 34,46 of tubular members 24,26 in longitudinal alignment with exhaust outlet 102 is at a minimum (at 47) and, in fact, is closed over a substantial peripheral portion thereof. The cross-sectional area of annular exhaust passage 56 above longitudinal axis 14 in FIG. 1 decreases from right to left, while the area below longitudinal axis 14 increases from right to left. This means that substantially all of the hot gases enter annular exhaust passage 56 generally diagonally opposite from exhaust outlet 102. Due to the fact that the annular passage is contracting from right to left above axis 14 while expanding from right to left below axis 14, the hot exhaust gases follow the path of least resistance and are caused to flow circumferentially around annular space 56 from the top toward the bottom thereof as seen in FIG. 1 while continuing to flow longitudinally until finally discharged through exhaust outlet 102.

In an arrangement where inner tubular member 24 is concentric with outer tubular member 26, the hot exhaust gases simply follow the path of least resistance and flow directly to exhaust outlet 102 without flowing around and through the entire annular passage.

The varying shape of annular exhaust passage 56 along the length thereof is shown in FIGS. 2–5. Reference numeral **14*a* may be considered a horizontal reference plane passing through longitudinal axis 14. Plane 14*a* provides a reference for portions of heat exchanger A located above that plane and for portions located below that plane. Exhaust outlet 102 is located adjacent first ends 32,44 of tubular members 24,26, and extends generally radially of longitudinal axis 14 substantially perpendicular to plane 14*a* on one side thereof. In the preferred arrangement, and with plane 14*a* extending horizontally, exhaust outlet 102 is on the bottom side of the plane and extends vertically downwardly. On the opposite or upper side of plane 14*a*, annular passage 56 is of a maximum size adjacent second ends 34, 46 of tubular members 24, 26 and progressively decreases in size when proceeding longitudinally toward exhaust outlet 102. On the bottom side of plane 14*a*, annular exhaust passage 56 is of a minimum size and is actually closed over a substantial peripheral portion thereof adjacent second end 46 of inner tubular member 24 at 47. The size of annular passage 56 on the bottom side of plane 14*a* progressively increases when proceeding longitudinally toward exhaust outlet 102**.

Figure 4:
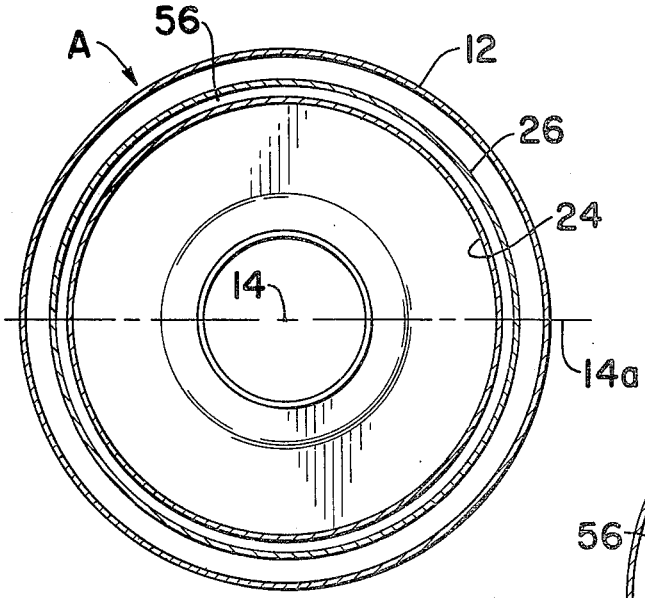
FIG. 4 is a cross-sectional view taken generally along lines 4—4 of FIG. 1; and, FIG. 5 is a cross-sectional view taken generally along lines 5—5 of FIG. 1.
Figure 5:
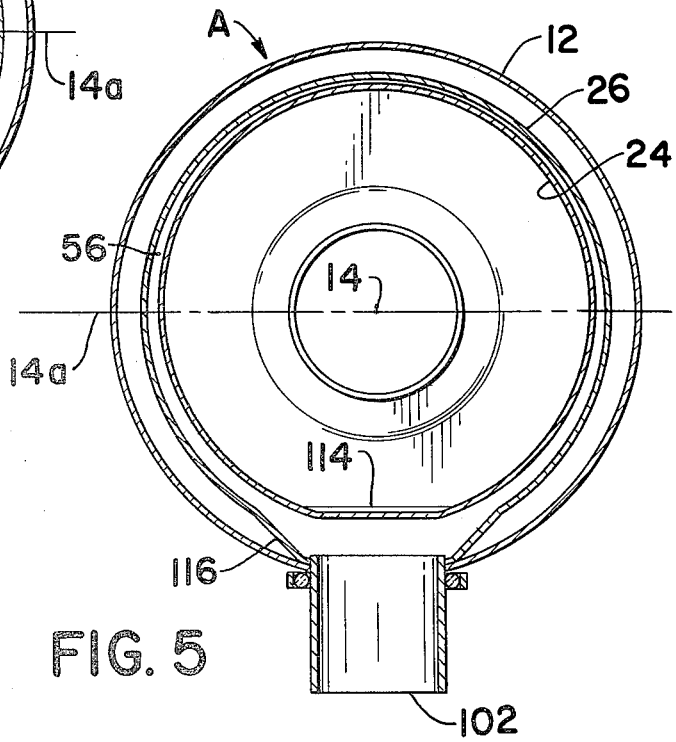

At an immediate location between second end 46 of inner tubular member 24 and exhaust outlet 102, and as shown in FIG. 4, annular exhaust passage 56 is actually substantially symmetrical about longitudinal axis 14. At all other longitudinal locations (FIGS. 3 and 5), the cross-sectional shape of annular passage 56 is non-symmetrical about longitudinal axis 14. At the same time, the cross-sectional area of annular exhaust passage 56 remains substantially constant along its entire length because the decreasing area on one side of plane **14*a* is taken up in a corresponding expanding area on the opposite side of the plane. This highly advantageous arrangement causes the exhaust gases to flow both longitudinally and circumferentially through annular exhaust passage 56 toward exhaust outlet 102**.

Annular exhaust passage 56 may be considered as having a radial width radially of longitudinal axis 14. At a location intermediate second end 46 and exhaust outlet 102 as represented by FIG. 4, this radial width is substantially symmetrical about axis 14. On the other hand, the radial width of annular exhaust passage 56 is substantially non-symmetrical about axis 14 adjacent exhaust outlet 102 and adjacent second ends 34,46. This non-symmetrical arrangement is designed so that the radial width adjacent second ends 34,46 is at a minimum in generally longitudinal alignment with exhaust outlet 102 and is at a maximum generally 180 degrees therefrom. At the same time, the exhaust passage radial width adjacent exhaust outlet 102 is at a maximum in generally longitudinally alignment with outlet 102 and is at a minimum generally 180 degrees therefrom.

The invention has been described with reference to the preferred embodiment. Obviously, modifications and alterations will occur to others upon a reading and understanding of this specification. It is intended to include all such modifications and alterations insofar as they come within the scope of the appended claims or the equivalent thereof.

Having thus described the invention, it is now claimed:

1. A heat exchanger having a longitudinal axis along which a plane extends to provide a reference for portions of said heat exchanger located on opposite sides of said plane, elongated inner and outer tubular members having first and second opposite ends and extending generally along said axis in cooperative relationship to define a generally annular passage therebetween, said second end of said inner tubular member being open and said second end of said outer tubular member being closed, an exhaust outlet in said outer tubular member adjacent said first end thereof on one side of said plane, a burner mounted adjacent said first ends for discharging gases into said inner tubular member and from which such gases flow around said second end thereof into said annular passage and back toward said first ends to discharge through said exhaust outlet, said tubular members being cooperatively positioned such that said passage on said one side of said plane has a cross-sectional area which is a minimum adjacent said second ends and gradually increases toward said first ends while having on the opposite side of said plane a cross-sectional area which is a maximum adjacent said second ends and gradually decreases toward said first ends, whereby a major portion of the burner exhaust gases flow from said inner tubular member around said second end thereof and into said annular passage on said opposite side of said plane and then flow generally longitudinally along and circumferentially around said passage over to said one side of said plane for discharge through said outlet.

2. The heat exchanger as defined in claim 1 wherein said passage is completely closed over a substantial peripheral portion thereof on said one side of said plane adjacent said second ends of said tubular members.

3. The heat exchanger as defined in claim 1 wherein said tubular members are substantially cylindrical.

4. The heat exchanger as defined in claim 1 wherein said exhaust outlet extends substantially radially of said longitudinal axis.

5. The heat exchanger as defined in claim 1 wherein said heat exchanger is positioned for operation with said longitudinal axis and said plane extending substantially horizontally, said one side of said plane being below said plane and said opposite side thereof being above said plane.

6. The heat exchanger as defined in claim 5 wherein said exhaust outlet extends substantially perpendicular to said plane.

7. The heat exchanger as defined in claim 1 wherein said passage has a substantially uniform cross-sectional area along the length thereof.

8. The heat exchanger as defined in claim 1 including a tubular housing surrounding said outer tubular member in outwardly-spaced relationship thereto and having a closed housing end spaced from said closed second end of said outer tubular member, and support means between said closed ends of said housing and outer tubular member for supporting said outer tubular member concentrically within said housing and maintaining said closed ends spaced from one another.

9. A heat exchanger comprising:

elongated inner and outer tubular members having an annular exhaust passage therebetween and being outwardly surrounded by a housing cooperating with said outer tubular member to define an annular heat exchanger passage through which fluid flows for transfer of heat thereto from said outer tubular member, said housing having a longitudinal axis and said tubular members having first and second opposite ends, a lateral exhaust outlet from said exhaust passage extending through said housing and said outer tubular member adjacent said first ends and discharging gases which flow through said inner tubular member in one direction and then said exhaust passage in a generally reverse direction, said exhaust passage having a radial width generally radially of said longitudinal axis, said radial width of said exhaust passage at a location intermediate said outlet and said second ends being substantially symmetrical about said axis and adjacent said exhaust outlet and said second ends being substantially non-symmetrical about said axis, the non-symmetrical arrangements of said radial width of said exhaust passage being reversed adjacent said second ends and said exhaust outlet such that said radial width of said exhaust passage adjacent said second ends is a minimum in generally longitudinal alignment with said outlet and is a maximum generally 180 degrees therefrom while adjacent said exhaust outlet said radial width of said exhaust passage is a maximum in generally longitudinal alignment with said outlet and is a minimum generally 180 degrees therefrom.

10. The heat exchanger as defined in claim 9 wherein said exhaust passage has a substantially uniform cross-sectional area along the length thereof.

11. The heat exchanger as defined in claim 9 wherein said exhaust passage portion of minimum radial width in generally longitudinal alignment with said outlet adjacent said second ends is substantially closed.

12. The heat exchanger as defined in claim 9 wherein said inner and outer tubular members are substantially cylindrical and are of different diameters, said outer tubular member having a longitudinal axis substantially coincidental with said longitudinal axis of said housing, and said inner tubular member having a longitudinal axis which intersects said longitudinal axes of said housing and said outer tubular member at a point located intermediate said second ends and said exhaust oulet.

13. The heat exchanger as defined in claim 9 wherein said housing is positioned with said longitudinal axis thereof extending substantially horizontally and said exhaust outlet opens substantially vertically downwardly.

14. The heat exchanger as defined in claim 9 wherein said second end of said outer tubular member is closed and said housing has a closed end spaced from said closed end of said outer tubular member, and support means between said closed ends for supporting said outer tubular member substantially concentrically within said housing and maintaining said closed ends in spaced relationship.

15. A heat exchanger comprising:

elongated inner and outer tubular members positioned in cooperating relationship to define an annular passage therebetween and having first and second opposite ends, said second end of said inner tubular member being open and said second end of said outer tubular member being closed, said passage having a lateral exhaust outlet extending through said outer tubular member adjacent said first end thereof, a burner mounted for discharging hot gases into said inner tubular member and then around said second end thereof into said annular passage for flow in a generally reverse direction to said exhaust outlet, said annular passage having a varying cross-sectional shape along the length thereof such that at a location adjacent said second ends diagonally opposite from said exhaust outlet said passage has a maximum cross-sectional area which progressively decreases along the length thereof toward said exhaust outlet while at a location adjacent said second ends in longitudinal alignment with said exhaust outlet said passage has a minimum cross-sectional area which progressively increases along the length thereof toward said exhaust outlet.

* * * * *